US009290993B2

(12) United States Patent
Harr et al.

(10) Patent No.: US 9,290,993 B2
(45) Date of Patent: Mar. 22, 2016

(54) METHOD AND SYSTEM FOR INSTALLATION OF IN-GROUND CONDUIT

(71) Applicants: Robert E Harr, Kasilof, AK (US); J. Dana Pruhs, Anchorage, AK (US)

(72) Inventors: Robert E Harr, Kasilof, AK (US); J. Dana Pruhs, Anchorage, AK (US)

( * ) Notice: Subject to any disclaimer, the term of this patent is extended or adjusted under 35 U.S.C. 154(b) by 153 days.

(21) Appl. No.: 13/764,634

(22) Filed: Feb. 11, 2013

(65) Prior Publication Data

US 2014/0027183 A1 Jan. 30, 2014

Related U.S. Application Data

(60) Provisional application No. 61/597,522, filed on Feb. 10, 2012.

(51) Int. Cl.
*E21B 7/20* (2006.01)
*E21B 7/04* (2006.01)
*E21B 7/00* (2006.01)

(52) U.S. Cl.
CPC . *E21B 7/04* (2013.01); *E21B 7/002* (2013.01); *E21B 7/20* (2013.01); *E21B 7/205* (2013.01); *E21B 7/046* (2013.01)

(58) Field of Classification Search
CPC ..... E21B 7/002; E21B 7/20; E21B 7/046; E21B 7/061; E21B 7/04; E21B 7/205
See application file for complete search history.

(56) References Cited

U.S. PATENT DOCUMENTS 4,401,170 A * 8/1983 Cherrington ..... 175/73
2005/0029016 A1* 2/2005 Self et al. ..... 175/74
2008/0217068 A1* 9/2008 Barbera ..... 175/122

* cited by examiner

*Primary Examiner* — Brad Harcourt
(74) *Attorney, Agent, or Firm* — Dorsey & Whitney LLP

(57) ABSTRACT

The present disclosure is directed toward systems and methods for trenchless installation of a conduit. According to the examples herein, a conduit may be installed underground using the conduit itself for the drilling of the bore hole needed to accommodate the conduit. The conduit may be installed after a drill string has been positioned in the ground to define a pilot hole. After the pilot hole is defined and while the drill string used to define the pilot hole remains underground, the conduit may be driven underground following the path defined by the drill string. A driving force may be applied to the conduit and cutting member attached to a leading end of the conduit to cause the conduit to advance underground while the drill string, a portion of which may be interior to the conduit, remains underground. In this manner disadvantages associated with back reaming and/or pulling or dragging of the conduit underground may be avoided, as the conduit may itself be used for enlarging the pilot hole to a size sufficient to accommodate the conduit.

21 Claims, 5 Drawing Sheets

METHOD AND SYSTEM FOR INSTALLATION OF IN-GROUND CONDUIT

CROSS-REFERENCE TO RELATED APPLICATIONS

This application claims priority from U.S. provisional application No. 61/597,522, filed on Feb. 10, 2012, which is incorporated herein by reference.

TECHNICAL FIELD

This disclosure relates to trenchless installation of conduit, and more specifically to methods and systems for installing a conduit using the conduit by passing over a drill string previously installed underground.

BACKGROUND

The underground utility construction industry may involve directional drilling during which many obstacles may be encountered. Whether the obstacles are manmade or developed by soil conditions or earth formations, the challenges of completing a utility bore may be difficult to overcome, leading to loss of conduit, tools, or abandoning of the project altogether. Furthermore, environmental concerns and regulations may pose significant challenges to directional drilling operations which use methods currently available in the industry.

Directional drilling operations may encounter various challenges, some of which man made, while others naturally occurring. For example, creeks, rivers, ocean approaches, wetlands, deep valleys, and many other terrain conditions may pose challenges to conventional directional drilling and utility conduit pull-type operation, as such terrain may present difficult soil conditions. Often, when directional drilling into the surrounding soils, a driller may encounter rock, cobbles, shot rock, and fill, that may cause a utility conduit pull operation to become extremely difficult.

Various sizes of directional drills may be used to install underground utilities, however there are many disadvantages to the methods currently known. Conventional directional drilling methods typically involve using a back reamer with a swivel joint to enlarge the pilot bore hole defined by the drill string. Back reamers are cutting tools having a large mass with multiple cutting teeth and are typically selected to be one and a half times larger than the size of the desired bore hole. The conduit to be installed is typically attached to the swivel joint of a the back reamer and pulled back through the bore hole behind the back reamer. Conduits, such as high density polyurethane (HDPE) pipes or steel pipes, may become stuck, may break or be pulled until critical damage to the conduit occurs, rending the utility and the conduit path likely unusable. In addition, loss of down-hole tools, which are often very expensive, may occur, leading to significant costs in recovering and/or repairing such tools. The swivel can cause a space between the back reamer and conduit, in which debris may fall into the path of the conduits being pulled thus leading to damage of the conduit or to the conduit becoming stuck in the bore hole In addition, back reaming may also lead to large voids under transportation surfaces, which may produce swells or large bumps in a traveled surface. Furthermore, the drilling system may hydra-lock causing drilling fluid to frack out. Fracking has become a concern, particularly when occurring near water ways or other protected environmental sites, and voluminous regulation is being put in place to limit or eliminate fracking in certain geographical areas.

BRIEF DESCRIPTION OF THE DRAWINGS

The accompanying drawings, which may be in schematic form, and which are incorporated into and form a part of the specification, illustrate one or more embodiments of the present application and, together with the description, serve to explain the principles of various embodiments. The drawings are only for the purpose of illustrating various embodiments, and are not to be construed as limiting. In the drawings.

DETAILED DESCRIPTION

Figure 1:
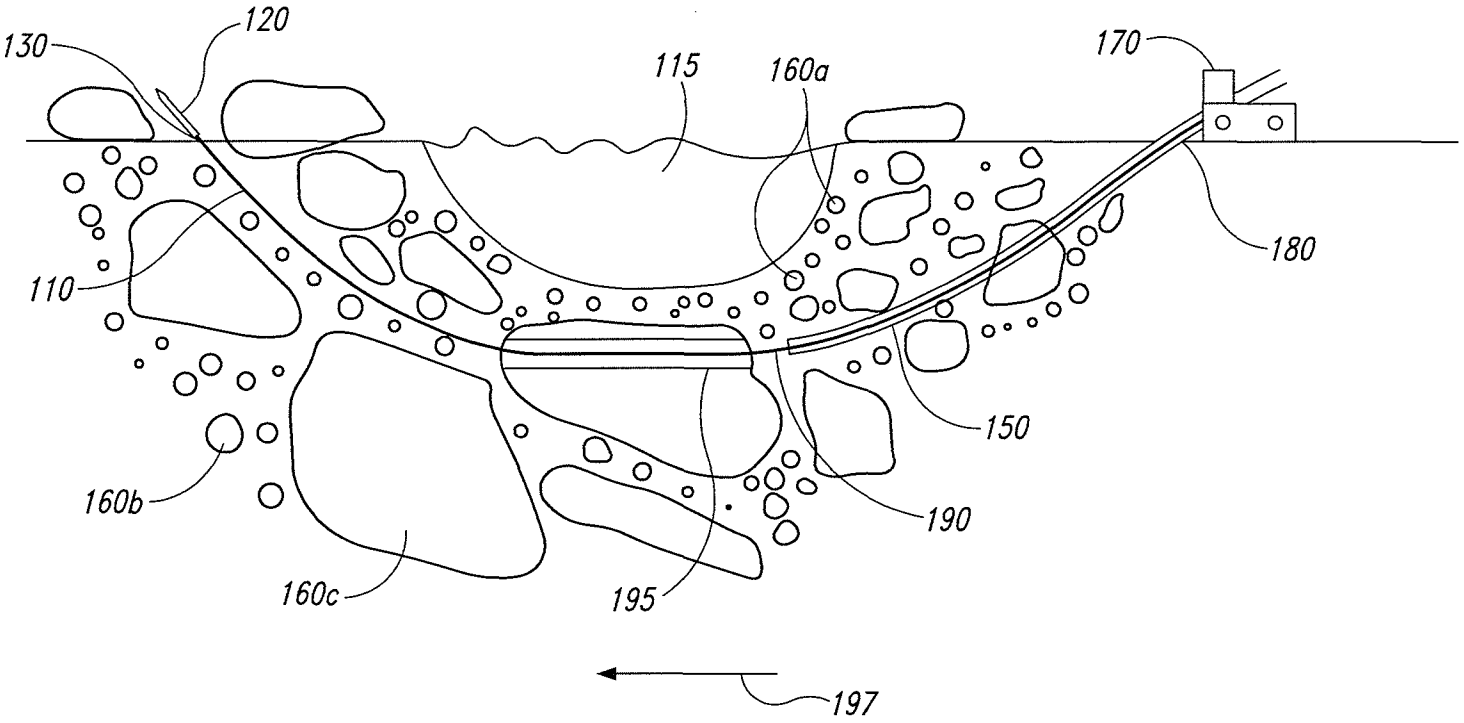
FIG. 1 shows an example directional drilling operation.

Certain details are set forth below to provide a sufficient understanding of embodiments of the invention. However, it will be clear to one skilled in the art that embodiments of the invention may be practiced without several of these particular details. In some instances, well-known circuits, structures, materials, and control signals have not been shown in detail in order to avoid unnecessarily obscuring the described embodiments of the invention.

Systems and methods for trenchless installation of a conduit are described herein. The systems and methods disclosed may eliminate the need of back reaming and pulling back of a conduit which, as described above, can result in irreparable damage and loss of the conduit, loss and damage of tools, and harmful environmental consequences some of which may be under strict governmental scrutiny and regulation.

Systems according to embodiments of the present invention may include a cutting member, which may be attached to a front end of a section of conduit. The system may include a coupler which may be coupled to the back end of the section of conduit being installed. The conduit with the cutting member and coupler may be positioned over an existing drill string, which has already been laid in the ground to define the desired bore path. The coupler may be coupled to a conventional horizontal drilling machine, interchangeably referred to herein as a directional drilling machine or simply drilling machine, which may be used to provide a force to the conduit, for example but not limited to a push or ramming force and/or rotational force. In this manner, a driving force may be applied to the conduit section to cause the conduit to move along the length of the drill string in the bore hole. In some examples, the coupler may also be coupled to a clutch assembly located near the front end of the conduit thereby providing a driving force to the front end of the assembly (e.g. directly to or proximate the cutting member.)

To facilitate an understanding of the present disclosure, a directional drilling (also known as, and interchangeably referred to as, horizontal drilling) operation will be described in reference to FIGS. 1 and 2. Directional drilling operations typically involve laying down a pilot bore hole 110 and 210 using a steerable drill bit 120, which typically includes electronic locating equipment to allow the drill bit to be tracked and steered underground. Once the drill bit exits at the exit end 130 of the bore hole, the bore is typically enlarged using a back reamer 240. The conduit 150 or 250, which will interchangeably be referred to as pipe, casing, or product, may be installed during the back reaming operation, as shown in FIG. 2, or after the back reaming and enlargement of the bore hole 210 is complete.

Figure 2:
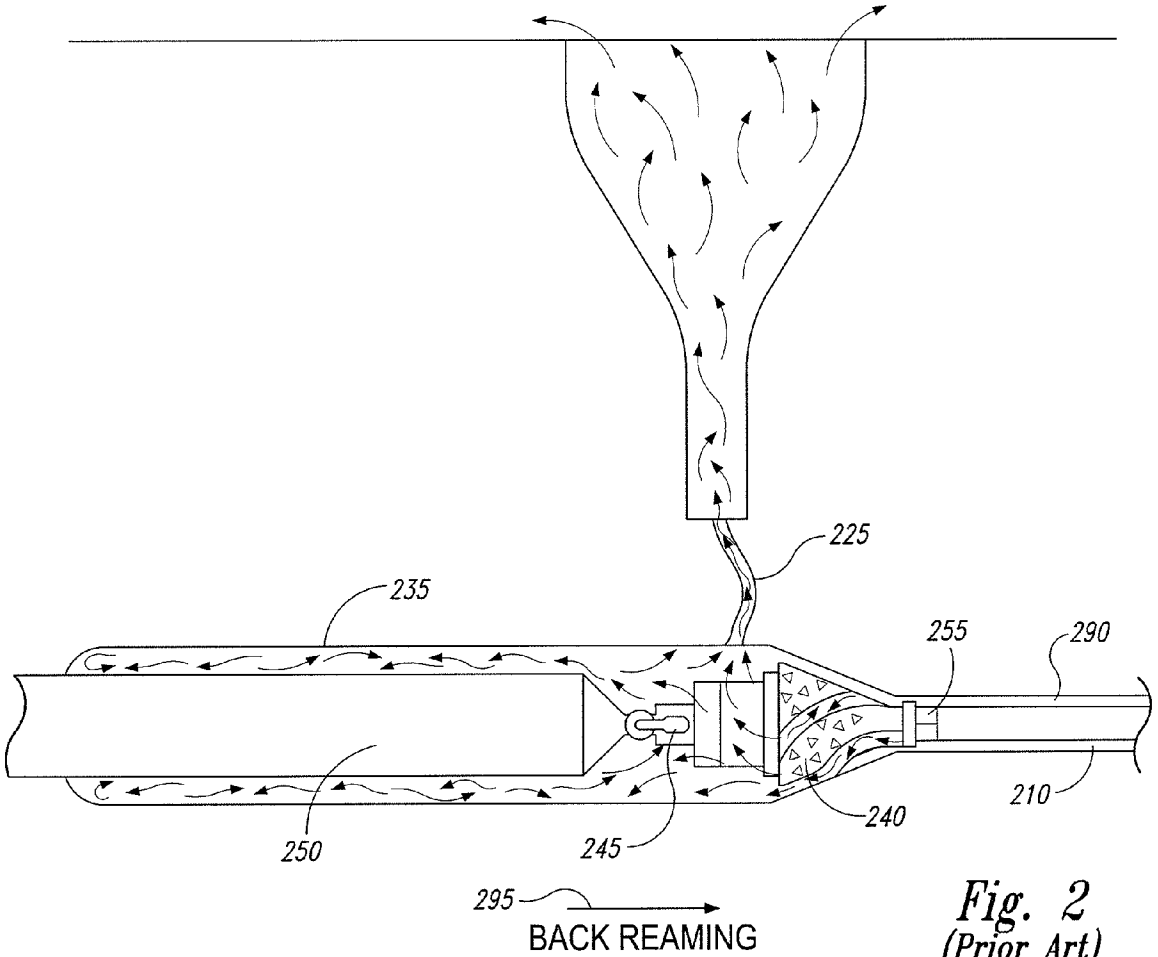
Fig. 2 (Prior Art)
FIG. 2. shows a conventional directional drilling system with a back reamer.

FIG. 1 shows an illustration of a horizontal drilling operation according to the present disclosure, where drilling may occur through various rock formations, which may include loose soil, cobbles 160*a*, rocks 160*b*, or boulders 160*c*, some of which may be very large. The terrain may also include an obstacle 115, for example, but not limited to a lake, a river, or a road, which the conduit must traverse under. Typically, when such an obstacle is present, a trenchless installation is necessitated (e.g. an installation of the conduit without digging an open trench). To accomplish a trenchless installation, and for example as shown in FIG. 1, a direction drill 170 is positioned at a first location, for example at an entrance location 180. A drill string 190 with a drill bit is used to define a pilot bore hole 110, also referred to herein as pilot hole or bore path. The drill bit may be propelled and steered through the soil using conventional methods. In some examples, the drill bit and drill string may pass through rocky soil including cobbles and rocks of various sizes. In some examples, the drill bit 120 and drill string 190 may cut and pass through larger rocks or boulders as indicated by path 195, navigating around which may be difficult or impossible. The installation of the drill string into the desired bore path may be said to be completed once the drill bit 120 reaches the desired second location (e.g. the exit location 130). The installation of the drill string into the ground may be completed immediately before the installation of the conduit or it may be completed sometime in advance, by the same or a different installation crew. The drill string may be installed underground by advancing the drill string generally along a first direction as indicated by the arrow 197. As will be understood, and as may depend on suitability of terrain or other conditions, the installation of the drill string may instead proceed in the opposite direction in some instances (e.g. from the depicted exit location to the entry location). The particular direction of placing the drill string underground depicted in FIG. 1 is illustrative only and should not be taken to limit the scope of this disclosure.

As mentioned above, and referring to FIG. 2, during conventional directional drilling operations the drill bit is then removed and a back reamer 240 with a swivel 245 is attached to the drill string 290 at the exit end 255. A conduit 250, which may comprise multiple strung up sections of conduit, is then connected to the swivel 245, and the reamer 240 is pulled back (e.g. along a direction 295 opposite the direction 195 for installation of the drill string) to enlarge the hole and pull back the conduit into the bore. The drill string 290 is pulled out of the ground in the process of installing the conduit, which is dragged behind the end of the drill string 290 and back reamer attached thereto. In some cases, the conduit is installed during a separate operation after the bore has been enlarged via back reaming and/or the drill string has been removed. As briefly described above, during back reaming, the conduit may be damaged, or become stuck effectively resulting in loss of the product and the bore hole. In addition to loss of conduit, back reaming may result in the loss of expensive tools. Furthermore, during conventional back reaming, drilling fluids, most of which may be toxic to the environment, are used to remove drilled cuttings and fill the enlarged bore which would subsequently be displaced by the product being pulled in. However, an undesirable result of back reaming is a condition called hydra-lock 235, which results when the fluid does not move down the bore hole and pressure builds up near the back reamer and swivel. When hydra-lock occurs, the fluid may escape to the surface in the form of a frack-out 225, which is undesirable and in many cases prohibited by regulation, as it can cause damage to structures or contamination of the environment.

Referring back to FIG. 1, unlike conventional conduit installation, which requires pulling the conduit through the bore hole typically behind the back reamer as described above, the systems and methods described herein may enable a push installation of the conduit (e.g. by driving the conduit underground from its rear end). Some or all of the disadvantages associated with back reaming and dragging the conduit underground may thus be avoided. As shown in FIG. 1, and as will be described in further detail below, once the drill string 190 is installed in the desired bore path and an exit 130 has been achieved, the drill string 190 may remain in the bore path hole 110. The product 150 (e.g. casing or conduit of desired diameter and length) may be installed without back reaming either from the entry side 180 or the exit side 130 using the systems and methods described herein. As indicated above, the installation of the conduit according to this disclosure may be accomplished by advancing the conduit along the path defined by drill string either along the same direction (e.g. 195) as used to install the drill string, or in the opposite direction (e.g. from the exit location to the entry location of the drill string). For simplicity, in the examples described, the drilling operation will be described from the entry side, but those of ordinary skill would appreciate that the drilling machine can be relocated to, or another drilling machine placed at, the exit side of the drill string and the conduit can be installed using the methods described from either end.

Figure 3:
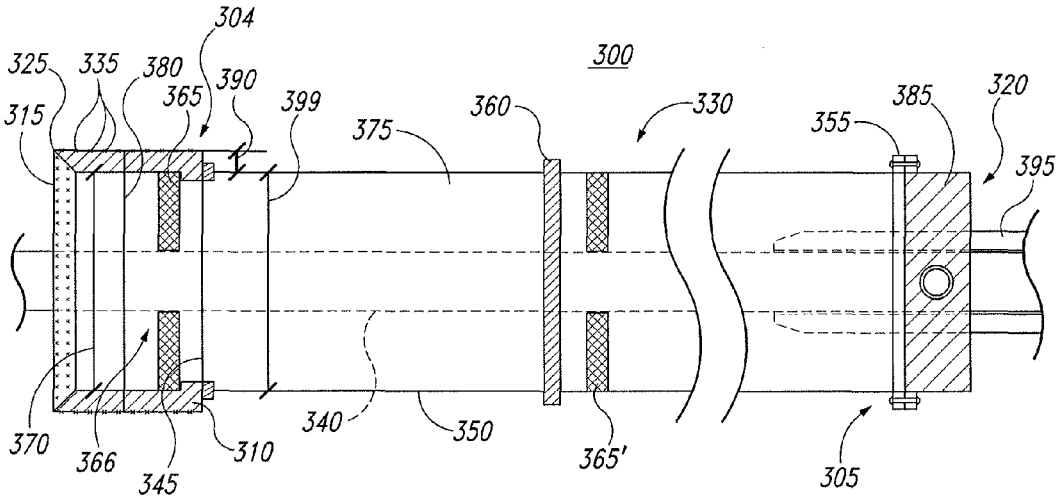
FIG. 3. shows a system according to an embodiment of the present invention.

FIG. 3 shows an illustration of a system according to an embodiment of the present invention. The system 300 may include a cutting member 310, and a coupler assembly 320. The cutting member 310 may be manufactured of any suitable material, for example drill steel or carbon steel. In some examples the cutting member 310 may be a metal drill bit. In some examples, the cutting member may be a steel pipe. As would be appreciated, the cutting member may be machined or otherwise manufactured into a shape and size suitable for the specific application. In some examples, the cutting member may have a complementary shape to the shape of the conduit 330. For example, in the case of installing a cylindrical conduit, the cutting member 330 may be cylindrical in conformity. Other form factors may of course be implemented. For example, the cutting member 330 may be shaped as arcuate sections arranged in a manner along the perimeter of the leading edge of the conduit so as to protect the leading edge and provide a cutting capability. In some examples, the cutting member 330 may be a steel pipe or may be formed from sections of a steel pipe. Materials other than steel may also be used. As would be appreciated by those skilled in the art, various sizes and shapes of cutting members may be implemented to work in conjunction with the different sizes of conduits 330 and/or drill strings 340 available in the drilling industry without departing from the scope of the present invention.

The cutting member may be configured to be attached to one end of a conduit section 350. As each section is installed, additional sections may be added and attached to the section already installed via a welding flange 360 or by welding consecutive sections of conduit directly to one another, as examples. In this manner a plurality of conduit sections may be strung together to obtain the desired length of conduit. As would be understood, other conventional methods for attaching one conduit section to the next may be used. The cutting member 310 may be attached to the conduit section 350 by any conventional means, such as welding, fusing, bolting, screwing or fastening a portion of the cutting member to a portion of the conduit section by any methods known in the art. In some examples, the cutting member 310 may include a threaded portion such that the conduit and/or the cutting member may be attached by screwing one into the other. In some examples, the cutting member 310 may include one or more grooves so as to enable the cutting member to be secured to the conduit via a tongue and groove joint. Other methods for joining the cutting member 310 to the conduit 350 may be implemented without departing from the scope of the present invention.

A cutting member 310, which may be a cylindrical member, may be positioned coaxially with respect to the conduit 350, such that the centerlines of the two align with each other. An end portion of the cutting member 310 may abut the conduit, or it may overlap a portion of the exterior or interior of the conduit. In some examples, at least a part of the end portion of the cutting member may fit inside the conduit and/or be secured to an interior surface of the conduit. The inner diameter 370 of the cutting member may be the same as or it may be different than the inner diameter of the conduit 350. The outer diameter 380 of the cutting member may be larger than the outer diameter of the casing. Preferably, the outer diameter 380 is large enough to produce an overcut 390 around the conduit as the conduit is being installed. In some examples, the outer diameter of the cutting member 310 may be selected such that a bore is created having a slightly larger diameter than the diameter 395 of the conduit. The overcut may allow the conduit to move freely into the bore as it is being installed. Furthermore, a bore with a larger diameter than the diameter of the conduit may be useful, for example to accommodate any additional structure located on the exterior of the conduit (e.g. the welding flanges 360 of adjoining sections).

Figure 4:
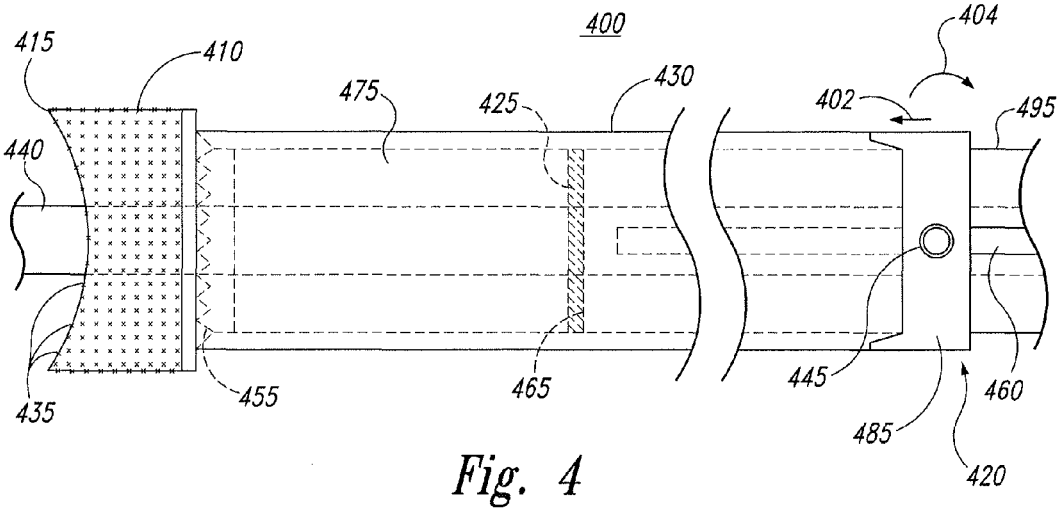
FIG. 4. shows a system according to another embodiment of the present invention.

FIG. 4 shows another example of a system according to an embodiment of the present invention. The system 400 may include a cutting head 410 and a coupler assembly 420. As can be appreciated, the cutting head 410 may have a leading edge 415 with a desired cross sectional profile suitable for the particular application. For example, the leading edge may be perpendicular to a direction along the length of the casing. In some examples, and as shown in FIG. 3, a leading edge 315 of the cutting member may be slanted so as to form an acute angle 325. Other cross sectional profiles may, of course, be implemented without departing from the scope of the invention.

Figure 5:
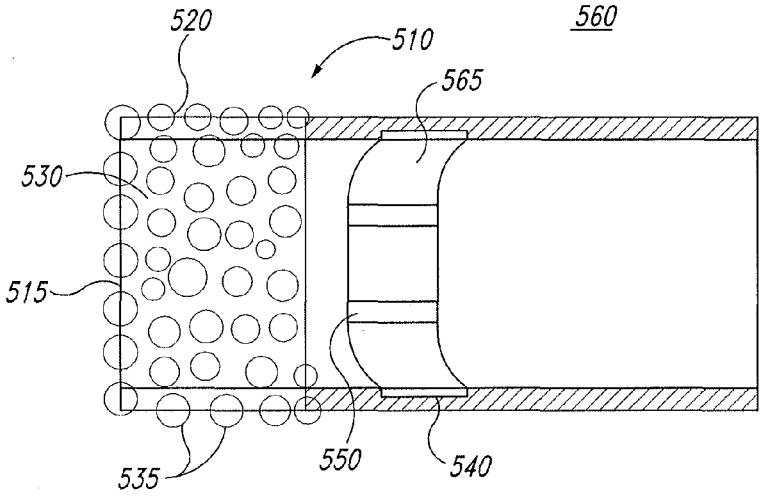
FIG. 5. shows an example cutting member according to an embodiment of the present invention.

FIG. 5 shows an example of a cutting member 510 according to an embodiment of the present invention. Cutting member 510, which may be metal, may include cutting elements 535, such as teeth, inserts, or chips disposed on one or more of the surfaces of the cutting member 510. The cutting elements 535 may comprise a material including a metal, a ceramic material, or a combination thereof. In some examples, the material may be carbide, such as tungsten carbide. Other materials such as polycrystalline diamond (PCD), diamond powder, and/or a variety of metals, for example hardened steel, may be used. As would be appreciated, other hard materials selected for their ability to cut through soil and/or rock formations may be implemented without departing from the scope of the present invention.

In some examples, the cutting elements 535 may be carbide inserts which may be pressed into, welded or brazed onto a surface 520 of the cutting member 510. In some examples, the cutting elements 535 may be fastened or otherwise affixed to holes drilled into one or more surfaces of the cutting member 510. In some examples, the cutting elements 535 may be disposed at the leading edge 515 and/or exterior surfaces 530 of the cutting member 510. In some examples and referring to FIG. 3, the cutting elements 335 may extend to a surface at least partially interior to the cutting member 310. As would be appreciated, various form factors, materials, and methods for attaching cutting elements to the cutting member may be implemented to suit varying soil conditions and/or drilling applications. Accordingly, the specific embodiments described are not to be taken in a limiting sense.

In some examples, the cutting member may comprise a plurality of carbide inserts 535 attached to one or more surfaces 520 and 530 of the cutting member 510. In some examples, the cutting member 510 may include one or more tungsten chips brazed or otherwise affixed to a surface of the cutting member. In some examples, the cutting member 510 may include teeth which are attached to or manufactured integrally with the cutting member. Many other structures and materials may be configured to provide the desired cutting surfaces of the cutting member and may be implemented without departing from the scope of the present invention.

As previously described, the cutting member 310 may be attached to one end 345 of a conduit to be installed to form a cutting assembly. The cutting assembly may include a sealing member 365, which may be interchangeably referred to herein as a bushing, which may be configured to seal the interior of the conduit, for example to prevent fluids from escaping from the interior of the conduit and/or to prevent debris from entering the interior of the conduit, as will be further described.

The sealing member 365 may be attached to an inner surface of the cutting member and/or an inner surface of the conduit. In some examples (e.g. in the case of a cylindrical casing and cutting element), the sealing member 365 may have an annular shape with an outer diameter select to fit inside the cylindrical casing and/or cutting element and with an inner diameter or hole size selected to fit over the drill string 340 installed in the ground. That is, the sealing member, which may extend generally perpendicularly to the drill string, may include an opening or hole 366 with a diameter sized to accommodate the drill string therethrough, such that when the cutting assembly is placed over the drill string, a generally enclosed cylindrical region 375 may be defined between the cutting assembly and the drill string. In some examples, the diameter of hole 366 of the sealing member 365 may be selected such that the sealing member fits sufficiently tightly over the drill string to prevent fluids (e.g. drilling fluid) from escaping from the enclosed region 375.

The sealing member 365 may provide a sliding contact between the cutting assembly and the drill string 340. The sealing member may be made of a low friction material (e.g. nylon) or may be coated with or otherwise treated to provide a low friction sliding contact. As would be appreciated, sealing members or bushings of various shapes and sizes may be implemented to fit over drill strings and inside conduits of various sizes. In some examples, the sealing member of bushing may be an integral component of the cutting member. In some examples, the sealing member 365 may be a removable component which can be replaced with another sealing member if desired. In this manner, the same cutting member may be fitted with differently sized sealing members for various applications. Any number of sealing members may be fabricated and/or provided as a kit, each sealing member having a hole diameter selected to accommodate one of a variety of drill strings of different diameters, such that the appropriately sized sealing member for the drill string being used may be selected from the kit and used in the particular installation job. Also, having a replaceable sealing member may facilitate cost savings by not having to replace the cutting member prematurely (e.g., prior to the cutting elements having been worn out).

Referring to FIG. 5, cutting assembly 560 may include a bushing 565, which may comprise a durable plastic material, such as nylon for example. Other materials may be implemented to provide the desired slidable contact and resistance to wear. The bushing 565 may be affixed to the inner surface of the cutting assembly 560 using any conventional means, for example with the use of adhesives, or various types of mechanical fasteners. In some examples, the bushing 565 may be fitted into a groove 540 machined into the inner surface of the cutting assembly 560. In some examples, the bushing 565 may be located proximate the front end of the cutting member thereby preventing debris from entering into the opening of the cutting assembly. In some examples, the busing may be positioned along the length of the cutting assembly 560, as shown in FIG. 5. In some examples, the bushing may include one or more slots, holes, or grooves 550 to provide air and/or fluid passages for lubricating the drill string and bore hole, as will be further described herein.

In some examples, multiple bushings 365 may be used to provide additional contacts along the length of the conduit, as shown in FIG. 3. As would be appreciated, the bushing 365 may provide centering of the conduit being installed around the existing drill string 340 already in the ground. The bushings may be attached to each conduit section prior to placing the conduit section over the drill string, or the conduit sections may be provided to the work site with the bushings pre-installed therein.

Referring back to FIG. 3, the coupler assembly 320 may include a coupler member 385 and a drive rod 395 (also referred to herein as a drill rod). The drive rod 395 may be any hollow rod as typically used in direction drilling to couple and transmit force from the drilling machine to drill bits, reamers, or other drilling tools. The drive rod may be configured to allow fluids to be pumped through the length of the rod.

The coupler member 385, or simply the coupler, may be configured to be coupled to the drive rod 395 and attached to the back end of a conduit section 350. In some examples, the coupler member 385 may be an annular plate, with an outer diameter substantially corresponding to a diameter of the product and with an opening to allow the drill string installed in the ground to pass through. In other examples, the coupler member 385 may be a cylindrical section or a conical section which may be configured to enclose the back end of the conduit section 350, while permitting the drill string to pass through as the conduit is being installed. In this manner, the coupler member 385 may function as a hatch, enclosing the back end of the conduit and defining enclosed region 375. In some examples, a gas and/or a fluid, or a combination thereof, may be delivered to the region 375, and through region 375 to the front of the cutting assembly, as will be further described.

The coupler member 385 may be removably coupled to the drive rod 395, which may, in some examples, be concentrically positioned over the existing drill string, or which may, in other examples, apply the driving force from the drilling machine at any other suitable location, for example at a perimeter location of the coupler. The coupler member 385 may be attached to an end 305 of the conduit opposite the cutting element by any conventional techniques. For example, the coupler member may be welded to the conduit, or to a welding flange 355 of the conduit. The coupler member may be a threaded coupler, as shown in FIG. 4, or it may be a pressure coupler. A clutch mechanism may be used to attach the coupler and/or drive rod to the end 305 of the conduit. In some examples, the coupler member may be fastened to the conduit using mechanical fasteners known in the art. Other means for fastening the coupler member to the conduit may be implemented.

In some examples, and referring to FIG. 4, the system may be equipped with a front drive assembly, also referred to herein as a forward clutch assembly. In such examples, the cutting member 410 may include a clutch engagement element 455. In some examples, the drive rod 495 may extend the full length of the conduit section being installed so as to be able to engage with the clutch engagement element 455 located near the front end 304 of the conduit. The clutch engagement element may be implemented as a rigid member comprising set of teeth and configured to engage with corresponding teeth coupled to or integral with a leading end of the drive rod 495. The front drive assembly may be implemented using any conventional clutch mechanism to couple the drive rod and the cutting member, or conventional rigid coupling mechanisms may instead be used for example the drive rod and cutting member may be rigidly fastened together by welding the drive rod and cutting member together, or by way of a threaded connection. In some examples, multiple drive rod sections similar to the drive rod 495 may be fastened together as indicated by the joint 425 such that the drive rod 495 may extend the full length of the conduit. As depicted in FIG. 4 as an example, the drive rod 495, in the case of front drive assembly, may have an outer diameter which is less than the inner diameter of the conduit such that the drive rod 495 may be inserted through and/or rotated within the conduit. The inner diameter of the drive rod When utilizing a clutch engagement arrangement, forces applied to the coupler assembly 420 at the rear end of the conduit being installed may be transmitted to a forward portion of the conduit assembly using the drive rod sections in addition to or instead of being transmitted through the conduit itself. For example, a forward push (e.g., as indicated by the arrow 402) and rotation (e.g., as indicated by the arrow 404), may, in this manner, be transmitted along a drive rod 495 (described in more detail below) and applied directly to the cutting member 410. The clutch engagement element 455 may be attached to the cutting member 410 or to the leading conduit section. In some instances, the cutting member 410 may be rotatably coupled to the front end of the conduit rather than being coupled rigidly, so as to allow the cutting member 410 to rotate independently from the conduit. In such instances the cutting member 410 may be rotated by way of a clutch engagement element and the conduit may not need to be rotated and/or transmit any rotational force.

As mentioned above, and referring to FIG. 4, the coupler member 485 may be further configured to be coupled to a drive rod 495. The drive rod 495, which may be similar to the drive rod 395, may be a cylindrical member. The drive rod 495 may be threaded at one or both ends. The diameter and thread design of the drive rod may be the same as those of a drill rod used in conventional horizontal drilling machines. In this manner, the drive rod may be used interchangeably or in conjunction with such conventional horizontal drilling machines. The drive rod 495 may be made of the types of materials, and using similar manufacturing techniques, as the kind used for the manufacture of conventional directional drill rods. For example, the drive rod 495 may be forged from high grade carbon steel and may be threaded at one or both ends such that it can be threaded into other drill rods. In some examples, the drive rod 495 may comprise 4120 grade steel. Drive rods of various sizes and thread designs may be implemented without departing from the scope of the present invention.

The drive rod 495 may include a plurality of slots 460 along its length. Slots 460 may be used for engagement with the coupler 485, and for delivery and control of fluids (e.g. a drilling fluid) and/or gas (e.g. air from an air compressor) into the enclosed region 475. For example, and as described herein, drilling fluid may be provided from a fluid source (e.g., a pump or other conventional equipment known in the drilling industry) through the drive rod 395, 495 to the interior of the conduit. Drilling fluid may also be expelled from the front end of the cutting assembly to lubricate the bore hole. For example, holes may be provided in the sealing element 365 to allow fluid to flow ahead of the leading end of the cutting assembly, or fluid may be pumped at sufficient pressure to force the fluid through the seal (e.g. between the contact surfaces of the seal and the drill string).

In some examples, a machined slot 460 may extend from a front end 465 to a distal end (not shown) of the drive rod 495. For the purposes of air and fluids sealing and for rod strength requirements, the slot may begin or stop some distance away from each end of the drive rod 495. In some examples, the slot may be spaced about 2 inches from each end of the drive rod 496. A choke valve 445, which may open at the distal end of the assembly, may be used to provide a balanced pressure inside the conduit.

In some examples, fluid and gas inside the conduit may be maintained at a predetermined pressure to pressurize the interior of the conduit. By pressurizing the interior of the conduit assembly increased flexural rigidity of the assembly may be achieved to better withstand driving forces being applied to the assembly during installation. Providing a gas and/or fluid through the conduit and out through the front end of the assembly may aid in lubricating the bore, as well as in the removal of debris and the prevention of debris from entering the enclosed region 475.

Figure 6:
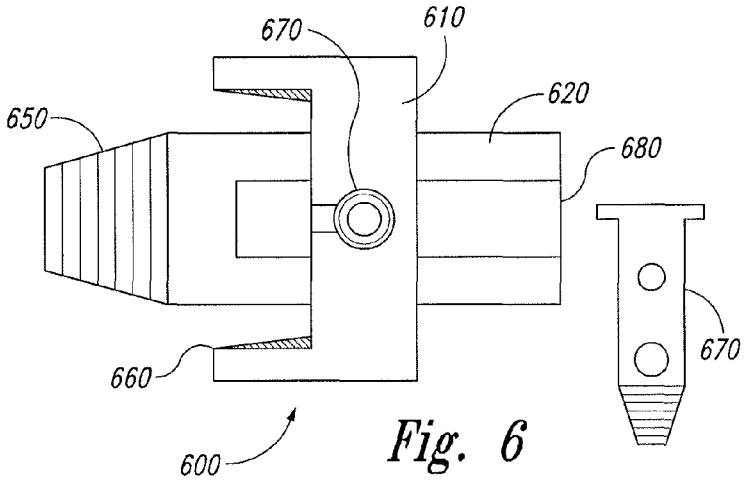
FIG. 6. shows an example coupler assembly according to an embodiment of the present invention.

FIG. 6 shows an example coupler assembly 600 according to an embodiment of the present invention. The coupler assembly 600 may include a coupler member 610 and a drive rod 620 having a plurality of slots 680. The drive rod 620 may also include a plurality of holes 630 in a hole pattern 640 along the length of the drive rod 620. In some example, a two foot spacing pattern may be used. In some examples, the plurality of holes 630 may be threaded and/or a plug may be installed in each hole. One or more of the plurality of holes may be used to allow air, fluids or mixture of both to be delivered from an external supply through the coupler assembly and into the enclosed region 375 previously described. The drive rod may include threads 650 of a standardized size or type such that the drive rod may be coupled to conventional horizontal drilling machines. The coupler member 610 may also include a threaded flange 660 for attaching the coupler assembly 600 to a conduit section. The coupler assembly may include a choke valve bolt 670, which may be used to control the delivery of gas and/or fluids into the conduit assembly, as previously described.

Figure 7:
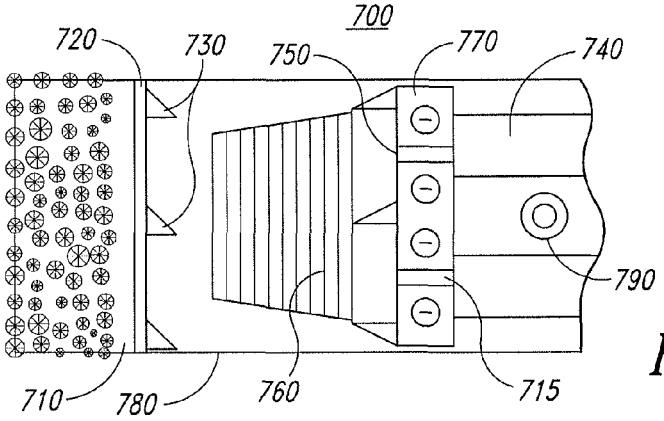
FIG. 7. shows an example of a cutting member with clutch engagement element according to an embodiment of the present invention.

As previously described, examples of systems according to embodiments of the present invention may include clutch engagement arrangements. FIG. 7 shows an example of a cutting assembly 700, which may include a clutched cutting head 710, a conduit section 780, and a drive rod 740. The clutched cutting head 710 may have a clutch engagement element 720 with a plurality of clutch teeth 730. The clutch engagement element 720 may lock into a clutch member 750 attached to a front end of a drive rod 740, as previously described. The assembly 700 may also include a bushing 770 for centering the drive rod inside the conduit and providing a seal. The bushing 770 may have a plurality of grooves or slots for fluid delivery through the front end of the cutting assembly. The drive rod 740 may include a threaded portion 760 at the front end and/or back end (not shown) of each drive rod section for fastening the drive rod to other drive rods along the length of the conduit. The drive rod 740 may include a valve 790 for control of fluid and/or gas delivery through the conduit and through the front end of the cutting assembly, as previously described.

Examples of methods for trenchless installation of a conduit are described in further detail below. An example method may include drilling a bore hole using the conduit, wherein the conduit is configured to traverse over an existing drill string installed in the ground while the drill string remains in the ground along the length of the bore hole path. The specific examples described herein are presented for illustration purposes only and do not limit the scope of the claims that follow.

Figure 8:
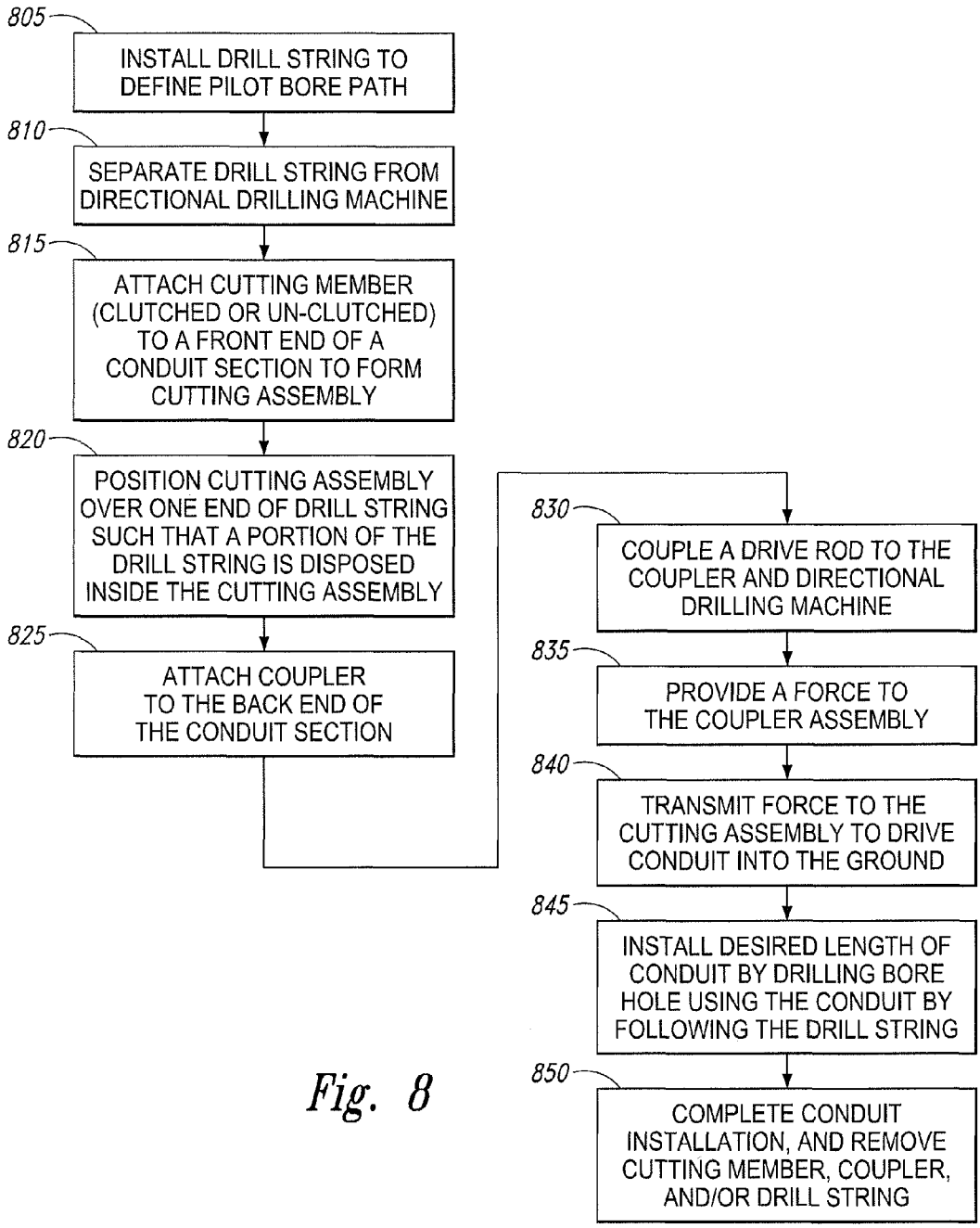
FIG. 8. shows a flow diagram of an example method according an embodiment of the present invention.

FIG. 8 shows a flow diagram of an example method for installing a conduit according to an embodiment of the present invention. As would be appreciated by those skilled in the art, steps may be added, or the steps described herein may be completed out of order or omitted altogether without departing from the scope of the present invention. As previously described, a directional drilling operation may begin by installing a drill string to define a pilot bore hole, as shown in step 805, using conventional methods for directional drilling. Once the exit point has been achieved, the drill string is separated from the directional drilling machine used to drill the pilot bore hole, as shown in step 810. As would be appreciated by the skilled artisan, a bore path may be engineered to limit critical flexing of the drill string and/or provide a more gradual degree or percentage of flexing for the anticipated conduit sections. In this manner, a suitable bore path may be defined for implementing a conduit installation according to the methods described.

A cutting member, such as a carbide drill bit for example, may be attached to one end of a first conduit section to form a cutting assembly, as shown in step 815. The carbide drill bit may be affixed to the front end of the conduit section by any means known in the art, such as welding, fusing, screwing, or bolting, as examples. The cutting member may be clutched or un-clutched, as previously described. A clutched cutting member may include a clutch engagement element for connecting the front end of the assembly to the coupler assembly and thereby transferring at least a portion of the applied force. In some examples, using a clutched cutting member may be preferable. For example, when installing conduits with thinner walls, or conduits made of less rigid materials, such as HDPE, or when traversing longer distances to completion (e.g. to the exit point), a clutched assembly may be preferable. However, as would be understood by those skilled in the art, un-clutched arrangements can be successfully implemented for numerous conduit types and soil conditions, as described herein. In some examples, the cutting member may not include a clutch engagement element and the coupler assembly may provide the applied force to the back end of the conduit section being installed. In some examples, a steel or alloy casing, for example, a casing with wall thickness of about ¼ inch or more, may be installed using the un-clutched methods described herein.

As previously described, conduits of various diameters may be installed using the methods described herein. In some examples, cylindrical conduits having 4 to 6 inch diameters may be installed using the systems and methods described herein. Conduits comprising materials used in the industry, including metal, plastic, or others, may be installed as described. The bore hole path may be engineered, and the size of the drill string selected, with the type of conduit being installed in mind. Also, as described, cutting members and couplers for a variety of conduits and a variety of conventional drilling machines may be implemented such that the components of the systems described herein may be used in conjunction with drilling equipment available in the industry. Cutting members and coupler assemblies may be implemented to suit the particular product installation and soil conditions to be encountered.

The cutting assembly may be positioned over the drill string, such that at least a portion of the drill string is disposed inside the cutting assembly, as shown in step 820. In some examples, the drill string, which is typically hollow in conformation, may be capped at the end from which the conduit will be installed to prevent fluids and/or air from entering the drill string and escaping from the other end of the drill string. A coupler assembly may be attached to the back end of the conduit section being installed, as is shown in step 825. As previously described, the coupler assembly may be configured to be coupled to a conventional horizontal drilling machine, such as by screwing a threaded portion of the assembly to a conventional drill rod of a drilling machine, for example. As would be appreciated by those skilled in the art, one or multiple drill rods may be jointed to move the conduit forward along the existing drill string and attain the desired distance. As discussed, the coupler assembly may include a drive rod, which may be a slotted high grade carbon steel rod with one or more slots along the length of the rod for engaging the coupler member and the fluid choke valve.

The assembly may then be coupled to a directional drilling machine, as shown in step 830. A force, typically provided by the directional drilling machine, is applied to the drive rod, as in step 835, and transmitted to the conduit through the coupler assembly as in step 840. The driving force may include any type of force that can be generated by the drilling machine, for example, push and/or rotation, a pulsating actuation, a pull, or any combinations of these or other suitable type of actuation. In some examples, a hammer assist may be implemented to enhance the installation of the conduit. A hammer assist may generally provide a hammering action which may include short and/or rapid hammer thrust movements which can be used to punch through or break apart brittle material in the soil. Hammer assist may generally enhance the drilling operation, for example by providing quicker drilling with less effort.

In some examples, a gas (e.g. air), or a fluid (e.g. water or a suitable drilling fluid), or any combination of the above, may be used for debris removal and/or lubrication of the bore hole. The use of drilling fluids may offer numerous advantages as will be appreciated by those skilled in the art. For examples, gas, fluids, or a combination thereof may be used to flush or blow debris soils and/or rock cutting from the front of the cutting member and away from the drill string. In some examples, the gas, fluids, or a combination thereof may be used to lubricate the bore hole, including lubricating along the drill string and/or the region around and behind the overcut. In this manner, the product being installed may slide along the drill string and move down the bore hole without much or any resistance from the surrounding soil.

When the installation of one conduit section is completed for the length of that conduit section, the coupler assembly may be removed to allow for another conduit section to be joined to the conduit section already installed. The coupler assembly may be reattached to the back of the new conduit section and the process is repeated to complete installation of the new section to conduit length, as shown in step 845. This process may be repeated until the front end of the cutting assembly achieves the exit point thereby completing the conduit installation, as shown in step 850. The cutting member and coupler assembly may be removed from the front end and back end, respectively. Subsequently, the drill string may be uncapped at the entry point, re-attached to the drilling machine and retrieved from the bore hole. Bushings may be positioned intermittently along the length of the conduit to center the conduit about the drill string during installation and during removal of the drill string, so as to minimize damage or scoring of the interior of the conduit.

According to some examples, a system for installing a conduit is described herein. The system may include a cutting member which is configured to be coupled to a first end (e.g. front end) of a conduit section. The cutting member and conduit may have interior diameters which are greater than the diameter of the drill string such that the cutting member and conduit to which the cutting member is attached may be threaded over the drill string. When the cutting member and conduit are placed underground the cutting member and conduit will generally be positioned around the drill string. In some instances, the cutting member and conduit may be generally coaxial with the drill string and may be maintained in a coaxial or centered arrangement as described herein. The system may further include a coupler which is configured to be coupled to a second end (e.g. rear end) of the conduit and the coupler may be further configured to be coupled to a directional drilling machine for transferring a force to the conduit. The coupler may also include an opening sized to allow the drill string to pass through the coupler. One or more drill rods may be used to couple the coupler to the drilling machine as described herein. The coupler may be configured to allow a fluid (e.g. a drilling fluid) to be delivered from a fluid source to the interior of the conduit.

In some examples, the system may further include at least one sealing member which is configured to provide sliding contact between the cutting member and/or conduit and the drill string. In some examples, the sealing member may be attached to the cutting member thereby slidingly coupling the cutting member with the drill string underground. In some examples, the sealing member may be attached to the conduit thereby slidingly coupling the conduit to the drill string. The sealing member may include or be treated with a low friction material. In some example, the sealing member may be made of NYLON. Cutting members according to the present disclosure may include a plurality of cutting structures which have a hardness greater than a hardness of the conduit. In some examples, the cutting structures may be made of or include diamond, carbide, hardened steel, or combinations thereof. In further examples, the system may include a front drive assembly which enables coupling of the cutting member to the coupler or to a drill rod of the drilling machine for direct transmission of force to the cutting member. The front drive assembly may include a clutch engagement element configured to be disposed inside the conduit and configured to be coupled to the cutting member.

Methods of installing a conduit after a drill string has been positioned in a pilot hole underground between an entry location and an exit location may include drilling a bore hole wider than the pilot hole using a conduit section. The conduit section is configured to follow a path defined by the drill string with the drill string remaining underground between the entry location and the exit location during said drilling of the bore hole. The drilling of the bore hole may include rotating the conduit section about a longitudinal axis of the conduit section. In some instances the longitudinal axis of the conduit section may be substantially coaxial with the drill string, and in such examples, the conduit section is thus also rotated about the longitudinal axis of the drill string. The method may further include advancing a plurality of conduit sections along the path defined by the drill and following the advancing of the conduit sections underground, removing the drill string and leaving the plurality of conduit sections underground.

In some examples, the method may include coupling a cutting member to a first end of the conduit section, positioning the conduit section with the cutting member about a first end of the drill string such that at least a portion of the drill string is disposed inside the conduit section, attaching a coupler to a second end of the conduit section, wherein the coupler is configured to transfer a force to the conduit section, and applying the force to the coupler to cause the conduit section to advance along a path defined by the drill string. The force applied to the coupler and/or conduit section may include a push force, a pull force, a force selected to cause the conduit section to rotate and/or vibrate, or combinations thereof.

The conduit and cutting member may both be cylindrical members, and an outer diameter of the cutting member may be larger than the outer diameter of the conduit and may thereby facilitate the forming of an overcut. The cylindrical cutting member may be attached to the first end of the conduit section to form a front assembly. The conduit of the front assembly may be one of a plurality of conduit sections to be placed underground (e.g. a first conduit section). In further examples, after advancing the first conduit section a first distance, (e.g. almost the full length of the first conduit), the coupler may be detached from the first conduit section and a second conduit section may be attached to the second end of the first conduit section. The coupler may then be reconnected to a free end of the second section, and the installation may be continued by again applying a driving force to the coupler to advance the first conduit section and the second conduit section along the path defined by the drill string. In some examples a clutch mechanism may be engaged, the clutch mechanism being configured to transmit the driving force from the rear end of the conduit to the forward end. In this manner, driving force may be coupled to the front assembly to directly drive a rotation of the cutting element. In some examples, a fluid, such as a drilling fluid, may be provided to the interior of the conduit. The fluid may be delivered from a fluid source (e.g. a pump) to the interior of the conduit section and pumped through the interior and/or ahead of a leading edge of the conduit, as described herein.

The systems and methods described herein may offer many advantages and may solve some of the problems that exit in currently known conduit installation techniques. For example, significant cost savings and increased efficiencies may be achieved with the systems and methods disclosed. Furthermore, negative environmental impact due to directional drilling operations may be minimized as described below.

For example, as previously described, after directional drilling and installation of a drill string, a larger device, called a back reamer, is typically attached at the exit point of the drill string and used to enlarge the pilot bore hole. Often, the back reaming will cause voids under transportation surfaces leading to failures of railroads, airport surfaces, and traveled surface of the highways, as well as damage to other structures which may be built over the directional drilling path. In addition, large amounts of drilling fluids are pumped at high pressure to remove debris generated during the back reaming operation. Typically, a back reamer may be selected to produce a reamed hole which is one and a half times larger than the product (e.g. casing, pipe, or conduit) being installed causing a large void underground and around the product being installed. Often, the drilling fluids may become hydralocked and may create a swell or a frack that will allow the drilling fluids to escape into a water way or a transportation surface. Most conventional drilling fluids may not be able to support the weight of cobbles, shot rock, rocks and glacial till. Such rock formations may fall into the path of the conduit being pulled through and cause the conduit to get stuck, or the bore hole to collapse all together. In addition, most governing authorities consider the drilling fluids to be toxic to humans, fish and wildlife.

Because the systems and methods described herein may obviate the need for using a back reamer, only a small over cut may be produced outside of the casing or conduit being installed. Imparting a force on the conduit, such as rotation, push, hammer tap, with air, water, and/or both, for example, may allow the product (e.g. conduit) to be installed over the pilot bore hole made by the drill string, without the need for back reaming.

It is appreciated that the specific examples of the systems and methods for boring a hole using conduits described herein are provided for illustration and are not to be taken in a limiting sense.

What is claimed is:

1. A system for installing a conduit, the system comprising:

a cutting member configured to be coupled to a first end of the conduit, the cutting member having a diameter greater than a diameter of a drill string installed underground for positioning the cutting member and conduit around the drill string;

a sealing member configured to provide sliding contact between the cutting member or conduit and the drill string; and a coupler configured to be coupled to a second end of the conduit and to be further coupled to a directional drilling machine for transferring a force to the conduit, the coupler comprising an opening sized to allow the drill string to pass therethrough.

2. The system of claim 1, wherein the conduit is a cylindrical conduit having an outer diameter, and wherein the cutting member is further configured for drilling a bore hole with a diameter greater than the outer diameter of the conduit.

3. The system of claim 1, wherein the cutting member comprises a plurality of cutting structures having a hardness which is greater than a hardness of the conduit.

4. The system of claim 3, wherein the cutting structures comprise diamond, carbide, hardened steel, or combinations thereof.

5. A system for installing a conduit, the system comprising:

a cutting member configured to be coupled to be coupled to a first end of the conduit, the cutting member have a diameter greater than a diameter of a drill string installed underground for positioning the cutting member and conduit around the drill string;

at least one sealing member configured to provide sliding contact between the cutting member or conduit and the drill string, wherein the sealing member is configured to seal an interior of the conduit; and a coupler configured to be coupled to a second end of the conduit and to be further coupled to a directional drilling machine for transferring a force to the conduit, the coupler comprising and opening sized to allow the drill string to pass therethrough.

6. The system of claim 1, wherein the sealing member is attached to an interior surface of the cutting element, the sealing member having a hole sized to allow the drill string to pass therethrough.

7. The system of claim 1, wherein the sealing member includes or is treated with a low friction material.

8. The system of claim 1, wherein the sealing member comprises NYLON.

9. The system of claim 1, further comprising a front drive assembly configured for coupling the cutting member to the coupler or to a drill rod of the drilling machine for direct transmission of force to the cutting member.

10. The system of claim 9, wherein the front drive assembly includes a clutch engagement element configured to be disposed inside the conduit.

11. The system of claim 10, wherein the clutch engagement element is further configured to be coupled to the cutting member.

12. The system of claim 1 wherein the coupler is further configured to allow a fluid to be delivered from a fluid supply to an interior of the conduit.

13. A method of installing a conduit after a drill string is positioned in a pilot hole underground between an entry location and an exit location, the method comprising:

drilling a bore hole wider than the pilot hole using a conduit section, wherein the conduit section is configured to follow a path defined by the drill string, wherein the conduit is centered around the drill string by a bushing coupled to an interior of the conduit, where the bushing is configured to provide sliding contact between the conduit and the drill string, the drill string remaining underground between the entry location and the exit location during said drilling of the bore hole;

advancing a plurality of conduit sections along the path defined by the drill string; and removing the drill string leaving the plurality of conduit sections underground.

14. The method of claim 13, wherein said drilling a bore hole includes rotating the conduit section about a longitudinal axis of the conduit section.

15. The method of claim 13, wherein said drilling comprises:

coupling a cutting member to a first end of the conduit section;

positioning the conduit section with the cutting member about a first end of the drill string such that at least a portion of the drill string is disposed inside the conduit section;

attaching a coupler to a second end of the conduit section, wherein the coupler is configured to transfer a force to the conduit section; and applying the force to the coupler to cause the conduit section to advance along a path defined by the drill string.

16. The method of claim 15, wherein the force is a push force, a pull force, a force selected to cause the conduit section to rotate and/or vibrate, or combinations thereof.

17. The method of claim 15, wherein said coupling a cutting member comprises attaching a cylindrical member to the first end of the conduit section to form a front assembly, wherein the cylindrical member has a an inner diameter and an outer diameter, the inner diameter being greater than a diameter of the drill string and the outer diameter being greater than a diameter of the conduit.

18. The method of claim 17, further comprising engaging a clutch mechanism coupling the front assembly to the coupler to directly drive a rotation of the cutting element using the coupler.

19. The method of claim 15, wherein the conduit section is a first conduit section, the method further comprising:

after advancing the first conduit section a first distance, detaching the coupler from the first conduit section;

attaching a second conduit section to the second end of the first conduit section and reconnecting the coupler to a free end of the second section; and applying a driving force to the coupler to advance the first conduit section and the second conduit section along the path defined by the drill string.

20. The method of claim 13 further comprising during said drilling a bore hole, providing a fluid to the interior of the conduit and/or flowing the fluid ahead of a leading edge of the conduit through the interior of the conduit.

21. The method of claim 13 further comprising prior to drilling the bore hole, drilling the pilot hole by advancing the drill string in a first direction from the entry location to the exit location, and wherein said drilling the bore hole using a section of conduit includes advancing the conduit underground in a same direction as the first direction.

* * * * *